US006784847B2

(12) United States Patent
Ngo Bui Hung et al.

(10) Patent No.: US 6,784,847 B2
(45) Date of Patent: Aug. 31, 2004

(54) HIGH EFFICIENCY, HIGH POWER ANTENNA SYSTEM

(75) Inventors: Frédéric Ngo Bui Hung, Franconville (FR); Michel Francis, Wavre (BE)

(73) Assignee: Thales, Paris (FR)

( * ) Notice: Subject to any disclaimer, the term of this patent is extended or adjusted under 35 U.S.C. 154(b) by 0 days.

(21) Appl. No.: 10/065,015

(22) Filed: Sep. 10, 2002

(65) Prior Publication Data

US 2003/0071760 A1 Apr. 17, 2003

(30) Foreign Application Priority Data

Sep. 11, 2001 (FR) ..... 01 11738

(51) Int. Cl.[7] ..... H01D 9/00
(52) U.S. Cl. ..... 343/745; 343/715; 343/728
(58) Field of Search ..... 343/711, 712, 343/713, 715, 726, 728, 745, 748, 750

(56) References Cited

U.S. PATENT DOCUMENTS

| | | | | | |
|---|---|---|---|---|---|
| 2,769,169 | A | * | 10/1956 | Munzig | 343/822 |
| 3,818,480 | A | * | 6/1974 | West | 342/435 |
| 4,343,001 | A | * | 8/1982 | Anderson et al. | 343/745 |
| 4,611,214 | A | * | 9/1986 | Campbell et al. | 343/790 |
| 4,893,131 | A | * | 1/1990 | Smith et al. | 343/713 |
| 5,977,920 | A | | 11/1999 | Hung | 343/715 |
| 6,195,065 | B1 | | 2/2001 | Hung et al. | 343/876 |
| 6,404,396 | B1 | | 6/2002 | Hung et al. | 343/749 |
| 6,437,577 | B1 | * | 8/2002 | Fritzmann et al. | 324/523 |

* cited by examiner

*Primary Examiner*—Shih-Chao Chen
(74) *Attorney, Agent, or Firm*—Lowe Hauptman Gilman & Berner, LLP

(57) ABSTRACT

Antenna system composed of (N+1) virtually identical radiating structures with N greater than or equal to 1, said (N+1) structures being arranged parallel to each other and each radiating structure being connected to a power supply and impedance matching device. Use for frequency ranges between 1.5 to 30 MHz.

14 Claims, 8 Drawing Sheets

FIG.8
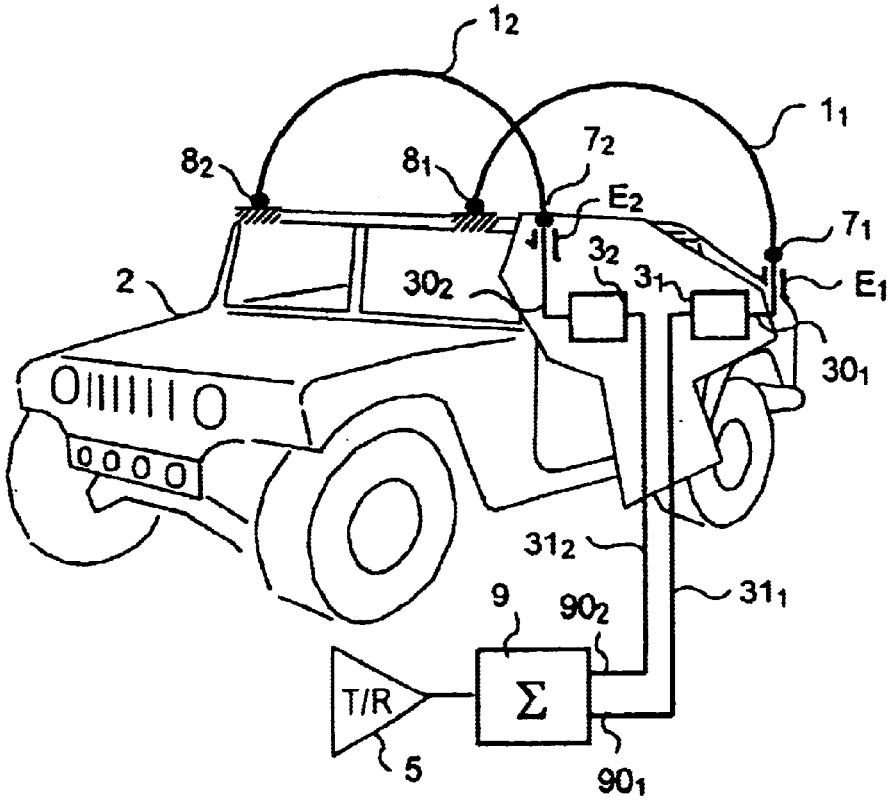
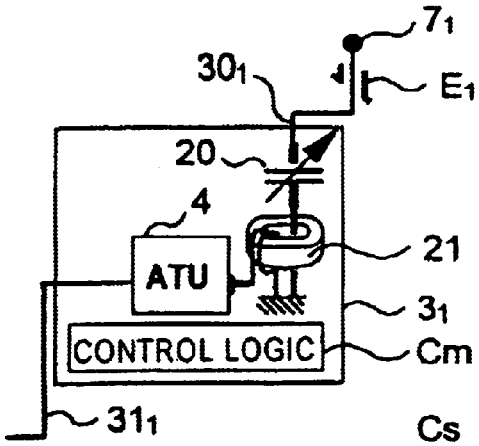
FIG.9

FIG.10
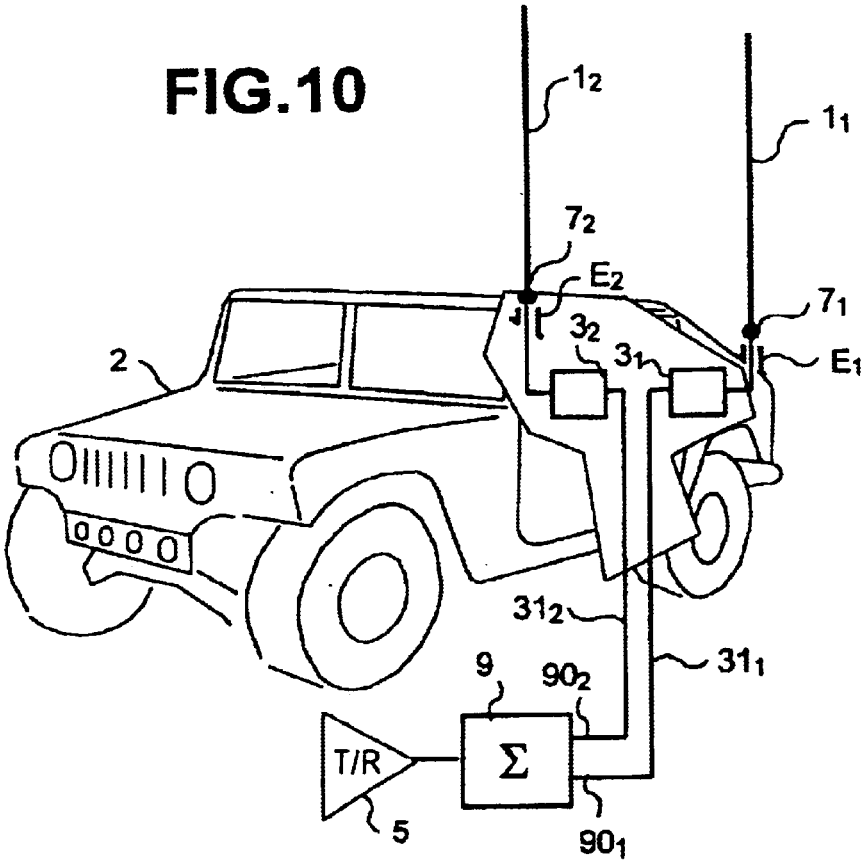
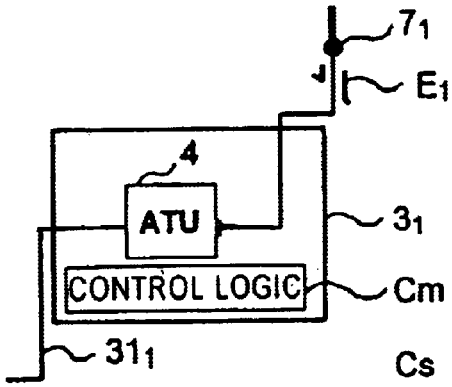
FIG.11

HIGH EFFICIENCY, HIGH POWER ANTENNA SYSTEM

BACKGROUND OF INVENTION

A radiocommunication system using the HF frequency range covers the frequencies from 1.5 to 30 MHz. The radiocommunication system is designed for installation on vehicles. The radiocommunications system generally requires antenna systems mainly composed of a radiating structure, a device to supply power to the radiating structure and an impedance matching device, usually called an ATU (Antenna Tuning Unit). The expressions "radiating element" and "radiation structure" both designate the same unit.

An example of this type of antenna system is shown on FIG. 1. In this example, the radiating structure 1, single-pole type, consists of a vertical whip attached by one of its ends 7 to a vehicle 2 by a base E, also acting as power supply device 6 by connecting the end 7 of the whip 1 to the power supply and impedance matching device 3. The whip is thus connected to a transmitter/receiver station 5 via the power supply and impedance matching assembly 3 comprising an impedance matching device 4.

This impedance matching device 4 has a known structure illustrated in FIG. 2 and comprising for example: A set of capacitive elements 41 and a set of inductive elements 42 which can be connected together and whose values can be adjusted through the use of switches 43 to form an LC type impedance matching network. This LC network can convert the complex impedance of the radiating structure 1 in order to present at the input of the transmitter/receiver station 5 (E/R) a impedance fixed according to the required operation, for example a value of approximptely 50 ohms, at the operating frequency, thereby tuning the antenna system, etc.

A processor 44 equipped with an algorithm AL which varies depending on the designers. The main functions of this algorithm consist especially of communicating with the transmitter-receiver station 5 in order to find the instantaneous operating frequency, of controlling the switches 43 and of managing, in particular, the tuning phase during which the algorithm varies, for example by successive iterations, the values of the capacitive elements and those of the inductive elements so that they converge towards the values leading to tuning.

The operation block diagram of this type of antenna system is shown in FIG. 3.

For links required over short and medium distances (typically in the region of 0 to 500 km) from a radiocommunication system installed on a mobile vehicle, the loop type radiating structure is the most suitable. Examples of this type of structure are described for example in the following patents U.S. Pat. Nos. 4,893,131, FR 2 553 586 and FR 2 785 094. FIGS. 4 and 5 schematise this type of structure.

A filiform conducting element 1 is bent over the top of a vehicle 2. This element is powered from one end 8 by a power supply device 6 composed of a broad band impedance transformer 10 and a connection cable 11 (FIG. 5). The other end 7 of this radiating element is connected to earth by a variable pretuning capacitor 12 to generate the radiating surface S of the loop type antenna structure. The radio frequency power supplied by the transmitter/receiver station 5 is transmitted to the power supply device 6 via an impedance matching device which is, in this example of realisation, integrated with the variable pretuning capacitor 12 in the same box 13. Due to this integration the variable capacitance can be controlled by the algorithm AL.

Other power supply and impedance matching assembly configurations can be used.

The antenna systems of the prior art, although efficient, nevertheless display certain limitations in their operation.

For example, if they are used on vehicles, especially on moving vehicles, the dimensions of the radiating structures must be either limited or restricted. The main consequences are: reduction in the efficiency of the antenna systems, sometimes significant, generation of high voltages and high currents in all component elements of the antenna system. This point limits the permissible power of these antenna systems for vehicles to approximately 100 Watts and means that the power supply device 6 must be separated from the pretuning capacitor, which is a disadvantage for integration of the antenna on its carrier vehicle.

Since they are unable to withstand high RF (Radio frequency) powers, especially those of the transmitter/receiver stations used on vehicles which can deliver several hundred Watts or even up to a thousand Watts, they cannot operate reactive elements such as the capacitive 41, 12 or inductive 42 elements, at very high load factors, resulting in a drop in reliability, and are not suitable for the implementation of high power switching components 43 whose switching times are too slow to follow the frequency hopping rates offered by the transmitters/receivers.

SUMMARY OF INVENTION

This invention concerns an antenna system comprising several radiating elements or structures arranged parallel to each other, each structure being connected to a power supply and impedance matching device.

It applies for example to radiocommunication systems using the frequency range between 1.5 and 30 MHz.

It also concerns an antenna system of small size operating in particular in the HF (high frequency) band covering the frequencies from 1.5 to 30 MHz, designed for installation for example on land vehicles to provide radio links by NVIS (Near Vertical Incidence Skywave) type ionospheric reflection.

It operates with frequency hopping radiocommunication systems.

The invention concerns an antenna system composed of (N+1) approximately identical radiating structures with N greater than or equal to 1, said (N+1) structures being arranged parallel to each other, each radiating structure is connected to a power supply and impedance matching device wherein it comprises at least a processor equipped with control logic Cm adapted to tune the "master" radiating structure to vary at least one of the tuning parameters and logic Cs adapted to transfer the parameters corresponding to the tuning of the "master" radiating structure to the "slave" radiating structure(s).

The power supply devices can be chosen to supply Radio Frequencies whose phases are approximately equal to most or all of the (N+1) radiating structures.

The system is used for example in the range of frequencies between 1.5 and 30 MHz.

The invention also concerns a method to tune an antenna system comprising (N+1) virtually identical radiating structures, with N greater than or equal to 1, comprising at least a step where each of the radiating structures arranged parallel to each other is powered and matched in impedance for a given operating frequency value wherein is comprises at least the following steps: associate to one radiating structure a master function and to the other radiating structures a "slave" function, transmit the tuning parameters of the master radiating structure to the slave radiating structures, vary at least one of the tuning parameters so that they converge towards values leading to tuning.

The method includes for example the following steps: a) initialise the tuning parameters for the "master" radiating structure, b) transmit the tuning parameters to the other radiating structures, c) determine the impedance value $Z_{measured}$ output from the "master" radiating structure and compare said value with a specified value $Z_{fixed}$, d) whilst the said determined value is different from the specified value, determine the values of the parameters required to tune the master radiating structure, e) vary at least one of the tuning parameters of the master radiating structure and repeat steps c to d.

ADVANTAGES The antenna system according to the invention offers in particular the following advantages:

It provides a higher and higher digital data rate (in bits/second) in radiocommunication in the HF (High Frequency) band, It can withstand radiofrequency powers from the transmitter-receiver stations ranging from several hundred watts to even one kilowatt, It improves the efficiency by increasing the radiation resistance of the radiating system, whilst remaining small enough for use on land vehicles, It limits the voltages and the currents developed in the reactive elements so that the pretuning capacitor and the power supply device can be grouped on one end, even for high transmitted power.

Since low power switching components can be used it is fast and reliable, unlike the systems of the prior art which must operate the reactive, capacitive or inductive elements at very high load factors, resulting in a drop in reliability, and which must implement high power switching components whose switching times are too slow to follow the frequency hopping rates offered by the transmitters/receivers.

BRIEF DESCRIPTION OF DRAWINGS

Other advantages and features of the invention will be clearer on reading the following description given as a non-limiting example, with reference to figures representing in.

DETAILED DESCRIPTION

The following description is given as a non-limiting example for an antenna system to be used in the HF frequency range from 1.5 to 30 MHz and installed on a vehicle.

Figure 1:
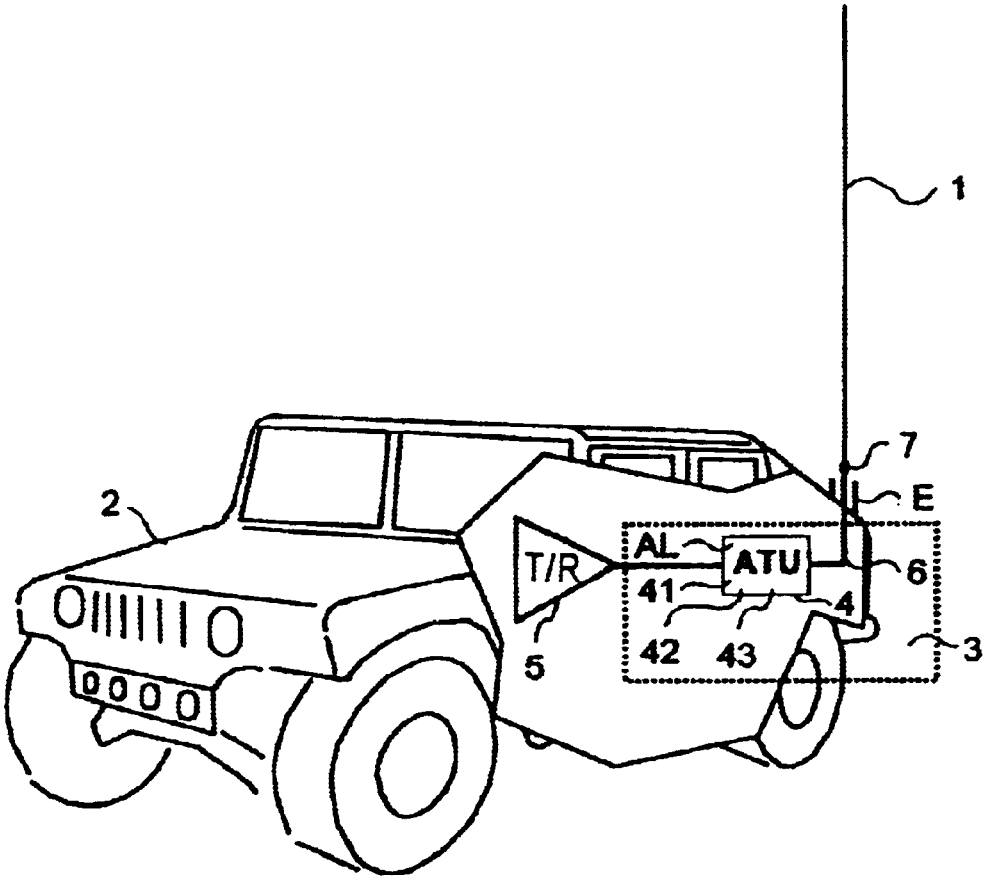
FIG.1 (PRIOR ART)
FIGS. 1, 2 and 3, an HF antenna system according to the prior art, details of an ATU and the system block diagram, FIGS. 4 and 5, an example of loop type antenna system, FIG. 6, a block diagram of the antenna system according to the invention and FIG. 7 a flowchart detailing the main steps of the method, FIGS. 8 and 9, an example of installation of the antenna system on a vehicle and a detail of the power supply and impedance matching assembly, FIGS. 10 and 11, another realisation variant based on single-pole antennae, FIG. 12, an example of antenna system for installation on a mast.
Figure 2:
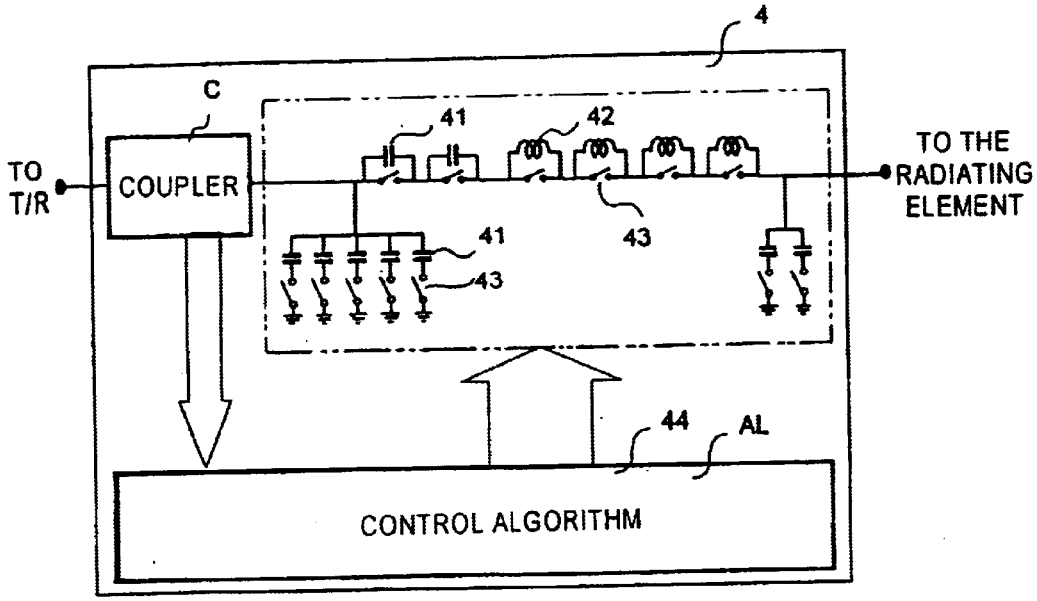
FIG.2 (PRIOR ART)
Figure 3:
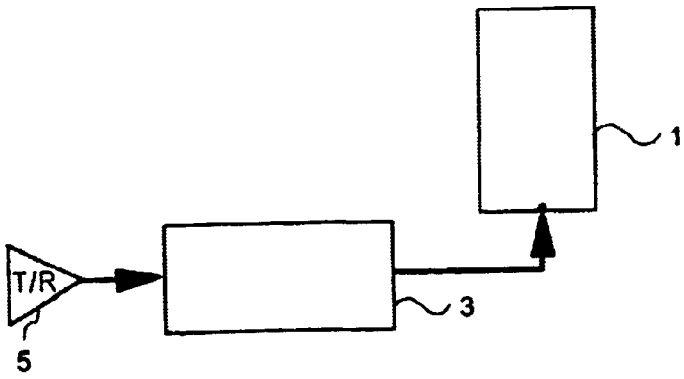
FIG.3 (PRIOR ART)
Figure 4:
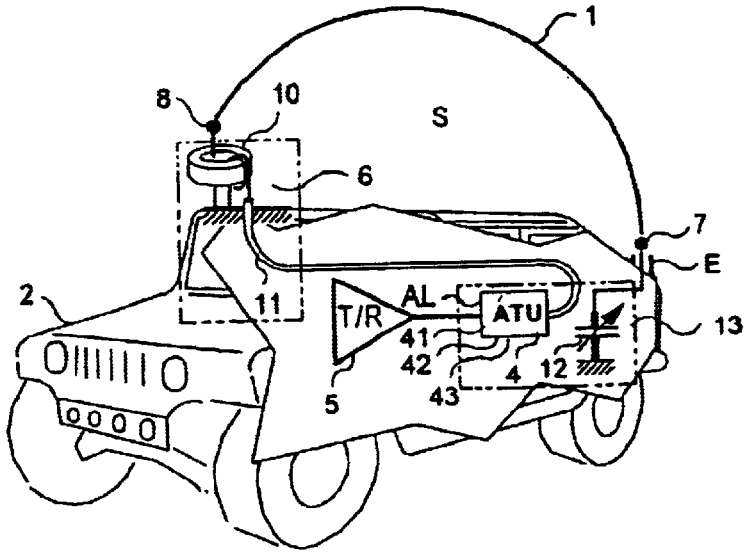
FIG.4 (PRIOR ART)
Figure 5:
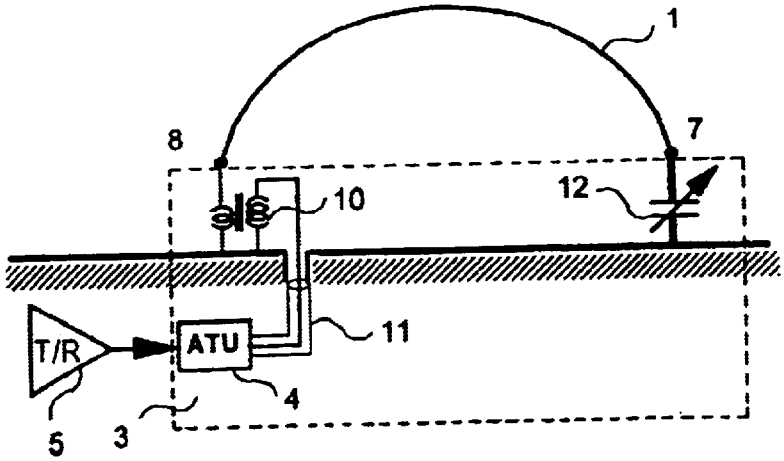
FIG.5 (PRIOR ART)
Figure 6:
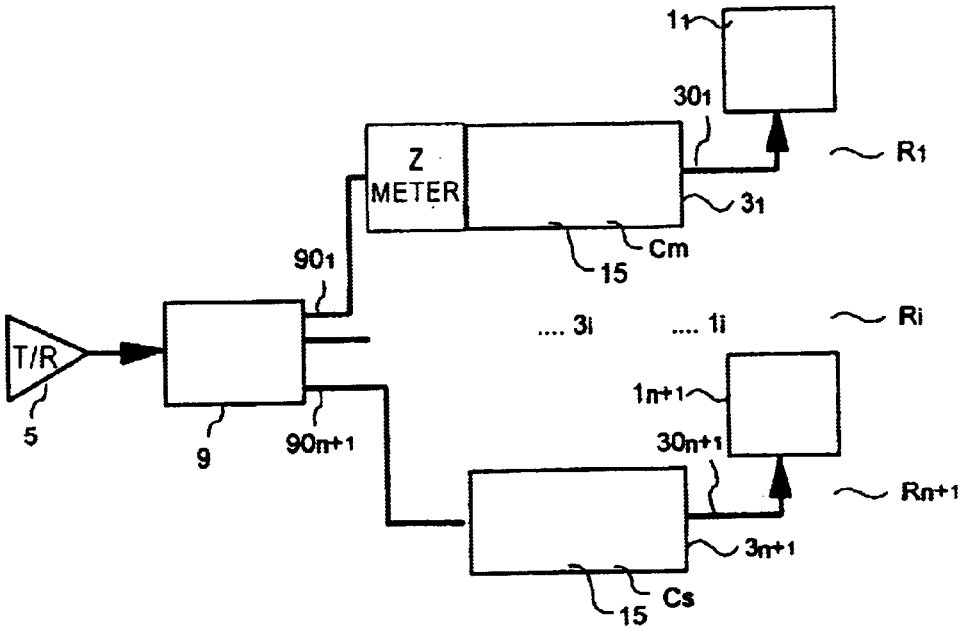

In reference to the block diagram on FIG. 6, the antenna system according to the invention comprises: A transmitter-receiver 5 connected to a power splitter 9 of ratio N+1 equal to the number of radiating elements used, N+1 assemblies $R_1, R_2, \ldots R_i, \ldots, R_n, R_{n+1}$ each comprising at least one radiating element $\mathbf{1}_1, \mathbf{1}_2, \ldots \mathbf{1}_i, \ldots, \mathbf{1}_n, \mathbf{1}_{n+1}$ associated with a power supply and impedance matching assembly respectively $\mathbf{3}_1, \mathbf{3}_2, \mathbf{3}_i, \ldots, \mathbf{3}_n, \mathbf{3}_{n+1}$, each assembly $R_i$ is connected to the power splitter 9 via a cable $\mathbf{90}_1, \mathbf{90}_2, \ldots \mathbf{90}_i, \ldots, \mathbf{90}_n, \mathbf{90}_{n+1}$, The N+1 radiating elements $\mathbf{1}_i$ are arranged in parallel, one of these elements acting as master and the N other elements as slave (on FIG. 6, element $\mathbf{1}_1$ is the master), A device Z (Zmeter) to measure the impedance output from the radiating element $\mathbf{1}_1$ designated as master, For the master element, a processor 15 equipped with control logic Cm whose main function is to provide active tuning during the tuning phase. The control logic Cm is used in particular to manage the antenna system tuning phase by varying the values of the variable elements of the power supply and matching assembly, such as the capacitive elements 41, the inductive elements 42 and the variable capacitor 12 so that they converge towards the values leading to tuning, For each of the N radiating elements acting as slave in a given operating configuration of the antenna system, a processor 15 equipped with control logic Cs whose main function is to copy at all times and therefore throughout the tuning phase the status of the master equipment, especially the tuning parameters, such as the values of the variable elements $\mathbf{41}_1$, $\mathbf{41}_2$l, . . . to respectively the variable elements $\mathbf{41}_i$, $\mathbf{42}_i$, . . . of the so-called "slave" power supply and matching assemblies.

Advantageously, the radiating resistance of the set of the N+1 radiating elements with respect to that of a single radiating element is multiplied by approximately N+1 and the same applies for the efficiency of the antenna system. Consequently, the power supply and matching devices only have to withstand one (N+1)th part of the total RF power delivered by the transmitter-receiver.

In the special case of an antenna system operating on a single fixed frequency, the values of the capacitors and inductors can be set manually to obtain the required tuning and in this case the processor control logic units will no longer be required.

Figure 7:
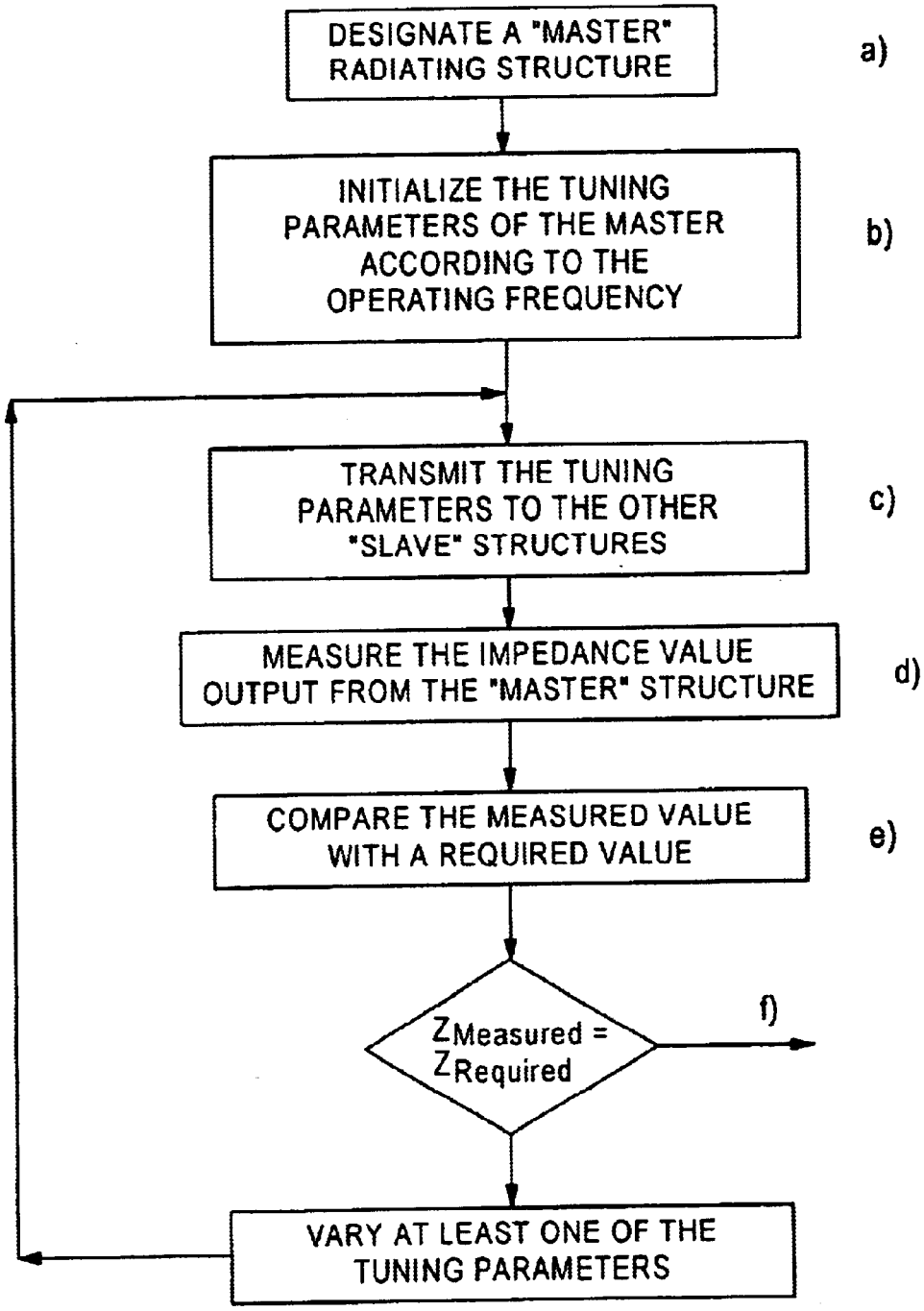

FIG. 7 represents as a flowchart an example of the steps implemented during the method in the special case where the system is equipped with control logic: a) designate one of the radiating elements as "master", b) initialise the tuning parameters of the "master" radiating structure according to the operating frequency of the antenna system, c) communicate the tuning parameters, for example the values of the capacitors and the inductors of the matching circuit to all the matching circuits of the "slave" radiating elements, the control logic Cs being used to copy the values from the master to the slaves, d) determine, for example by measuring, the impedance value output from the "master" radiating element, and compare the measured value $Z_{measured}$ with a required value $Z_{fixed}$, the latter value being chose, for example, to suit the operating conditions of the antenna system so as to obtain the required tuning, e) whilst $Z_{measured}$ is different or noticeably different from the value $Z_{fixed}$, determine the values of the parameters required to tune the master radiating structure, f) vary at least one of the values of the variable elements so that they converge towards the values leading to tuning and repeat steps c) to d). The tolerance is for example fixed at an SWR less than or equal to 1.5.

The values are varied using for example an iterative process using algorithms known by those skilled in the art.

The information is transferred from the "master" radiating structure to the "slave" structures for example by modulating them at a frequency different from the operating frequency and by using the cables 90*i*.

It can also be transferred by any other means known by those skilled in the art.

FIG. 8 represents an example of realisation of an antenna system according to the invention comprising two radiating elements installed on a vehicle and connected directly to the vehicle ground.

A first filiform radiating element $\mathbf{1}_1$ has one end $\mathbf{8}_1$ connected directly to the ground of the vehicle 2. The other end $\mathbf{7}_1$ is connected via a base $E_1$ to the input terminal $\mathbf{30}_1$ of the power supply and impedance matching assembly $\mathbf{3}_1$. A detailed example of this assembly is shown on FIG. 9. It comprises for example a variable pretuning capacitor 20 of which one terminal forms the input terminal $\mathbf{30}_1$ placed in series with the primary coil of a broad band impedance step-up transformer 21, an ATU connected to the secondary coil of the transformer 21 and control logic Cm enabling this assembly to operate as master. The same applies for the second filiform element $\mathbf{1}_2$ arranged parallel to the first element $\mathbf{1}_1$, approximately 0.5 m away so that these radiating elements do not touch each other when the vehicle moves. Similarly, ends $\mathbf{8}_2$ and $\mathbf{7}_2$ are connected respectively to the vehicle ground and to the input terminal $\mathbf{30}_2$ of the second power supply and impedance matching assembly $\mathbf{3}_2$. Since this second assembly is considered as slave with respect to the first assembly, it is equipped with control logic Cs, whose main function is to copy at all times, in particular during the tuning phase, the status of the first, or master, assembly.

The information exchanged between the various assemblies is carried out on buses known by those skilled in the art or by connecting cables, for example the coaxial cables $\mathbf{31}_1$ and $\mathbf{31}_2$ connecting the power supply and impedance matching assemblies $\mathbf{3}_1$ and $\mathbf{3}_2$ to the power splitter 9. These two cables connected to two separate $\mathbf{90}_1$ and $\mathbf{90}_2$ of the power splitter are the same length or approximately the same length so that the signals reach the radiating elements at the same time. The amplitudes and phases of the RF powers transmitted to the radiating elements $\mathbf{1}_1$ and $\mathbf{1}_2$, are therefore identical or at least as close as possible.

FIGS. 10 and 11 show a realisation variant where the radiating elements $\mathbf{1}_1$, $\mathbf{1}_2$ are single-pole type. In this case the power supply and impedance matching assemblies are connected directly to the ATU 4. One end $\mathbf{7}_1$, $\mathbf{7}_2$ of the radiating element is connected to the antenna system via the base $E_1$, $E_2$. FIG. 11 shows only one element for simplification purposes.

Figure 12:
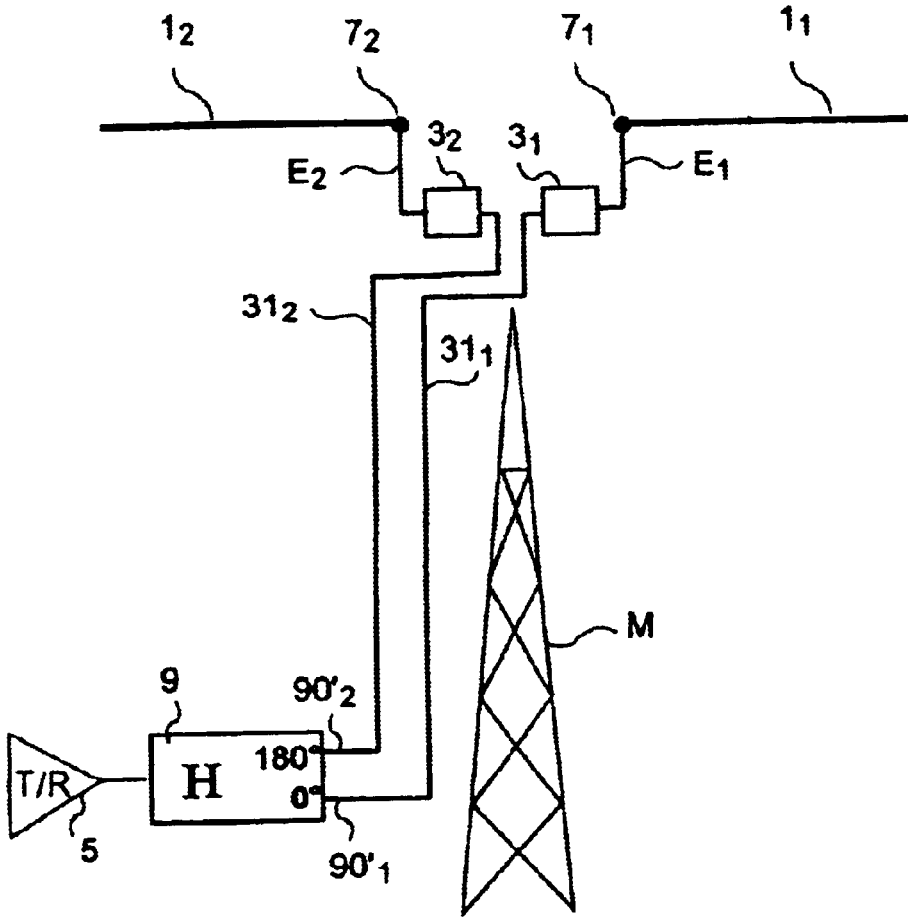

FIG. 12 shows a realisation variant where a dipole antenna is installed on a mast M. For levels of voltage and current generated in the component parts of the antenna identical to those corresponding to a dipole antenna equipped with a single ATU, this realisation can be used to transmit twice as much RF power. It consists of two monopole type radiating structures $\mathbf{1}_1$ and $\mathbf{1}_2$ installed horizontally, more or less in line and head to foot at the top of the mast. The ends $\mathbf{7}_1$ and $\mathbf{7}_2$ of the radiating structures are connected respectively to the two power supply and impedance matching assemblies $\mathbf{3}_1$ and $\mathbf{3}_2$ which operate respectively as master and slave. The two coaxial leads $\mathbf{31}_1$ and $\mathbf{31}_2$ of the same electrical length connect the two power supply and impedance matching assemblies to the outputs of a hybrid power splitter 0–180°, 9'. The two outputs $\mathbf{90'}_1$ and $\mathbf{90'}_2$ are in phase opposition.

What is claimed is:

1. An antenna system composed of (N+1) virtually identical radiating structures with N greater than or equal to 1, said (N+1) structures arranged parallel to each other, each radiating structure is connected to a power supply and impedance matching device wherein it comprises at least a processor equipped with control logic Cm adapted to tune the "master" radiating structure and vary at least one of the tuning parameters so that they converge towards the values leading to tuning and logic Cs for transferring the parameters corresponding to the tuning of the "master" radiating structure to the "slave" radiating structure(s).

2. The antenna system according to claim 1, wherein the power supply devices are chosen to supply Radio Frequencies whose phases are approximately equal to most or all of the (N+1) radiating structures.

3. The antenna system according to claim 2, wherein it comprises:

a first assembly consisting of a radiating structure ($\mathbf{1}_1$), a power supply and impedance matching assembly ($\mathbf{3}_1$) with control logic (Cm) enabling it to operate as master to manage the antenna system tuning phase by varying the values of the variable elements so that they converge towards the values reading to tuning; N additional assemblies ($R_2 \ldots, R_{n+1}$) virtually identical to the first assembly and placed in parallel to it, with control logic (Cs) of the power supply and impedance matching assemblies ($\mathbf{3}_i$, $\mathbf{3}_i \ldots \mathbf{3}_{n+1}$) adapted to operate as slave by copying at all times the statuses of the variable elements ($\mathbf{41}_1$), ($\mathbf{42}_1$), ($\mathbf{12}_1$) . . . of the master to respectively the variable elements ($\mathbf{41}_i$), ($\mathbf{42}_i$), ($\mathbf{12}_i$) . . . of the power supply and impedance matching assemblies ($\mathbf{3}_i$),a power splitter (9) from 1 input to N+1 outputs ($\mathbf{90}_1$) . . . ($\mathbf{9}_{n+1}$) connected to the N+1 power supply and impedance matching assemblies ($\mathbf{3}_1 \ldots \mathbf{3}_{n+l}$).

4. The antenna system according to claim 2, wherein:

the radiating structures ($\mathbf{1}_1$) . . . ($\mathbf{1}_{n+1}$) are loop type produced from a filiform conducting element which has one end ($\mathbf{8}_1$) . . . ($\mathbf{8}_{n+1}$) connected to earth and the other end ($\mathbf{7}_1$) . . . ($\mathbf{7}_{n+1}$) connected to the input ($\mathbf{30}_1$) . . . ($\mathbf{30}_{n+1}$) of a power supply and impedance matching assembly ($\mathbf{3}_{1-}$) . . . ($\mathbf{3}_{n+1}$) and wherein the power supply and impedance matching assemblies ($\mathbf{3}_1$) . . . ($\mathbf{3}_{n+1}$) are composed of at least:a broad band impedance step-up transformer (21), a variable pretuning capacitor (20) placed in series with the primary coil of a broad band impedance step-up transformer (21) and whose free terminal forms the input ($\mathbf{30}_1$) . . . ($\mathbf{30}_{n+1}$), an ATU (4) connected to the secondary coil of the transformer (21).

5. The antenna system according to claim 2, wherein the radiating structures ($\mathbf{1}_1$) . . . ($\mathbf{1}_{n+1}$) are single-pole type, produced from a filiform conducting element which has one end left free and the other end ($\mathbf{7}_1$) . . . ($\mathbf{7}_{n+1}$) connected to the input ($\mathbf{30}_1$) . . . ($\mathbf{3}_{n+1}$) of a power supply and impedance matching assembly ($\mathbf{3}_1$) . . . ($\mathbf{3}_{n+1}$).

6. The antenna system according to claim 1, wherein it comprises at least:

a first assembly ($R_1$) consisting of a radiating structure ($\mathbf{1}_1$), a power supply and impedance matching assembly ($\mathbf{3}_1$) with control logic (Cm) enabling it to operate as master to manage the antenna system tuning phase by varying the values of the variable elements so that they converge towards the values leading to tuning an additional assembly ($R_2$) identical to the first assembly ($R_1$) and placed head to foot with this first assembly ($R_1$), but whose control logic (Cs) of the power supply and impedance matching assembly ($\mathbf{3}_2$) makes it operate as slave by copying at all times during the tuning phase the statuses of the variable elements ($\mathbf{41}_2$), ($\mathbf{42}_2$), ($12_1$) . . . of the master to respectively the variable elements ($41_2$), ($42_2$), ($12_2$) . . . of this slave assembly ($3_2$), a hybrid power splitter (9') with one input and 2 outputs ($90'_1$) ($90'_2$) in phase opposition connected to the 2 power supply and impedance matching assemblies ($3_1$) and ($3_2$).

7. The antenna system according to claim 6, wherein the radiating structures ($1_1$) and ($1_2$) are single-pole type.

8. The antenna system according to claim 1 usable in a frequency range from 1.5 to 30 MHz.

9. The antenna system of claim 3, wherein the variable elements is one or more of capacitive elements, inductive elements and variable capacitors.

10. The antenna system of claim 6, wherein the variable elements is one or more of capacitive elements, inductive elements and variable capacitors.

11. A method to tune an antenna system comprising (N+1) virtually identical radiating structures, with N greater than or equal to 1, comprising at least a step where each of the radiating structures arranged parallel to each other is powered and matched in impedance for a given operating frequency value wherein it comprises at least the following steps:

associate to one radiating structure a master function and to the other radiating structures a slave function, transmit the tuning parameters of the master radiating structure to the slave radiating structures, vary at least one of the tuning parameters so that they converge and to obtain tuning.

12. The method according to claim 11 wherein it comprises at least the following steps:

a) initialise the tuning parameters for the "master" radiating structure, b) transmit the tuning parameters to the other radiating structures, c) determine the impedance value $Z_{measured}$ output from the master radiating structure and compare said value with a specified value $Z_{fixed}$, d) whilst the said determined value is different from the specified value determine the values of the parameters required to tune the master radiating structure, e) vary at least one of the tuning parameters of the master radiating structure and repeat steps c to d.

13. The method according to claim 11, wherein the parameters are transmitted by modulating the information at a frequency value different from that of the system operation.

14. The method according to claim 11, wherein the operating frequency range is chosen in the range 1.5 to 30 MHz.

* * * * *